United States Patent [19]

Sotolongo

[11] Patent Number: 4,772,212

[45] Date of Patent: Sep. 20, 1988

[54] ELECTRICAL CONNECTOR FOR SHIELDED CABLES WITH SHIELDED CONDUCTOR PAIRS

[75] Inventor: Thomas J. Sotolongo, Clearwater Beach, Fla.

[73] Assignee: AMP Incorporated, Harrisburg, Pa.

[21] Appl. No.: 52,519

[22] Filed: May 20, 1987

[51] Int. Cl.[4] ..... H01R 13/648

[52] U.S. Cl. ..... 439/98; 439/494; 439/497; 439/610

[58] Field of Search ..... 439/92, 95, 98, 99, 439/108, 404, 405, 417, 442, 492, 494, 497–499, 607–610

[56] References Cited

U.S. PATENT DOCUMENTS

| | | | |
|---|---|---|---|
| 4,062,616 | 12/1977 | Shaffer et al. | 339/99 R |
| 4,083,615 | 4/1978 | Volinskie | 339/17 F |
| 4,094,566 | 6/1978 | Dola et al. | 339/14 R |
| 4,147,399 | 4/1979 | Moser et al. | 339/99 R |
| 4,181,384 | 1/1980 | Dola et al. | 339/14 R |
| 4,225,207 | 9/1980 | Brandeau et al. | 439/497 |
| 4,272,148 | 6/1981 | Knack, Jr. | 339/143 R |
| 4,408,823 | 10/1983 | Huber | 439/497 |
| 4,437,723 | 3/1984 | Narozny | 339/99 |
| 4,460,228 | 7/1984 | Lane et al. | 339/99 R |
| 4,508,415 | 4/1985 | Bunnell | 339/143 |
| 4,640,569 | 2/1987 | Dola et al. | 339/143 |
| 4,687,263 | 8/1987 | Cosmos et al. | 439/497 |
| 4,693,539 | 9/1987 | Tighe, Jr. | 439/404 |

FOREIGN PATENT DOCUMENTS 2109648A 6/1983 United Kingdom .

*Primary Examiner*—J. Patrick McQuade
*Attorney, Agent, or Firm*—Robert W. Pitts

[57] ABSTRACT

An electrical connector assembly permitting interconnection of signal and ground conductors in a shielded flat cable to a standard connector member having a different signal ground configuration is disclosed. An adapter member having an insulative housing base and cover can be secured to the connector member. A plurality of signal terminals can be disposed in the base member to form insulation displacement terminations to the signal conductors. Separate ground shields surrounding associated pairs of conductors can be commoned using a ground terminal having a single transverse bus strip which is deployed over the cable in the insulative base. The assembled adapter base is received within an outer conductive shell which interconnects an outer cable shield to the outer conductive shell of the standard electrical connector to form a continuous shield.

10 Claims, 11 Drawing Sheets

10
12
14
16
18
2B
50
64
1
2
3
4
5
6
7
8
9
10
11
12
13
14
15
20a
20b
20c
20d
20e
22'
22"
24a
24b
24c
24d
24e
26
30

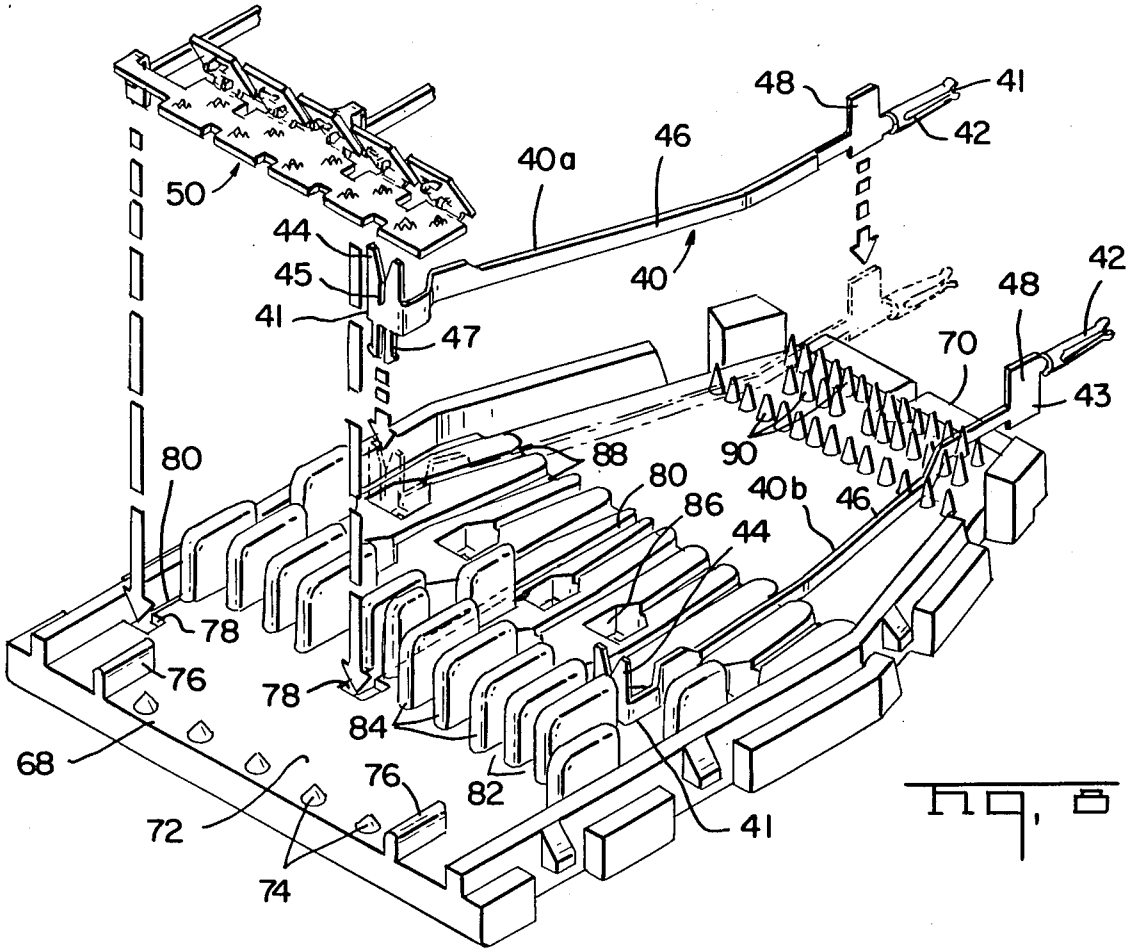
41
42
48
46
40
40a
50
44
45
47
41
42
43
48
70
90
40b
46
44
86
80
88
80
78
76
68
72
74
76
78
84
82
41

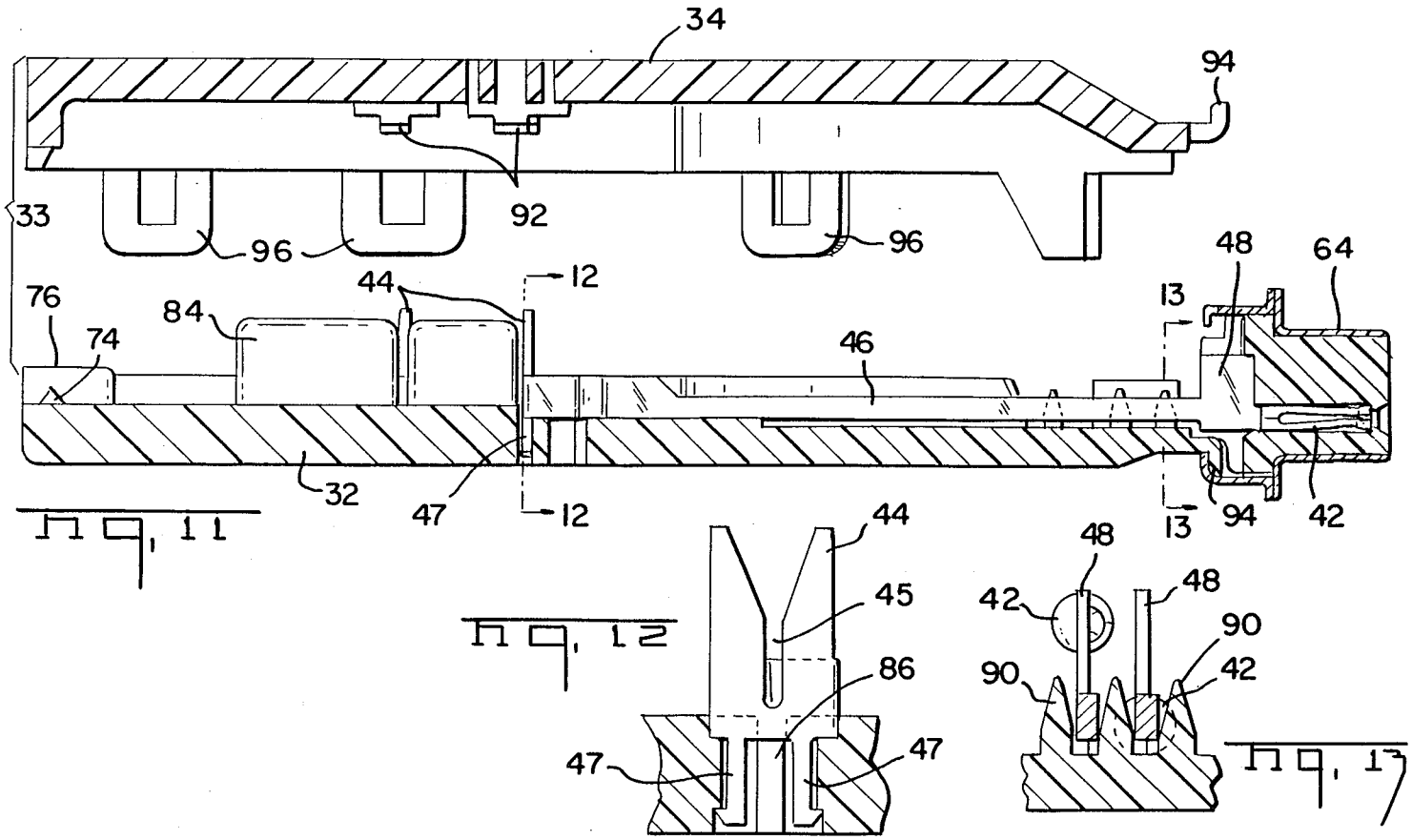
64
42
48
94
13
13
94
34
96
46
92
12
12
47
44
32
96
84
74
76
33
48
90
42
48
42
90
44
45
86
47
47

ELECTRICAL CONNECTOR FOR SHIELDED CABLES WITH SHIELDED CONDUCTOR PAIRS

BACKGROUND OF THE INVENTION

1. Field of the Invention

This invention relates to an electrical connector assembly for facilitating the interconnection of a flat cable containing a plurality of signal conductors surrounded by one or more EMI shields to an electrical connector in which predetermined signal and ground positions are established which are not related to the signal and ground configuration of the flat cable.

2. Description of the Prior Art

Multiconductor flat cables, in which a plurality of conductors are disposed within a common insulating web, offer a number of advantages over discrete wire cables. One paramount advantage is that such multiconductor cables can be easily mass terminated to electrical connectors having terminals positioned on centerline spacings corresponding to the centerline spacing of the conductors in the cable. There are, however, a number of multiconductor flat cable configurations in which other considerations dictate that the conductor spacing in the flat cable must differ from the positions occupied by terminals in a multicontact electrical connector. For example, the conductors in a flat cable can be quite small and positioned on extremely close centerlines. Practical manufacturing problems may prohibit the construction of terminals which can be located on the small centerline spacings occupied by the conductors. Examples of such configurations in which the conductors must be deployed to centerlines greater than that occupied in the cable to permit sufficient termination are depicted in U.S. Pat. No. 4,094,566 and in U.S. Pat. No. 4,181,384 where a connector member which is used to displace individual conductors laterally outward beyond their centerline spacing in the flat cable.

In other configurations, it may be necessary to attach a standard electrical connector, intended for use with discrete wires, to a flat cable in which the conductor centerline spacing differs from that of the standard connector. U.S. Pat. No. 4,147,399 discloses a flat cable connector assembly in which fanned out circuit traces are employed to interconnect the conductors of a flat cable with individual terminals positioned in multiple rows of a standard electrical connector. U.S. Pat. No. 4,437,723 discloses still another configuration which permits conductors in a flat cable to be interconnected to terminals in a multirow electrical connector by using intermediate contact elements which permit a transition from the centerline spacing of the conductors in the cable to the terminals positioned in a predetermined contact pattern.

Termination of multiconductor flat cable is even further complicated when ground or EMI shields are employed in the cable to improve the electrical transmission characteristics of the cable. It has been found that balance pair performance can be obtained in a low profile flat cable by encapsulating associated pairs of round wire conductors in a separate shield or ground surrounding each conductor pair. For cables of this type, it is then not only necessary to terminate the signal conductors of each pair, but some provision must be made for terminating the surrounding ground shields. U.S. Pat. No. 4,508,415 and U.S. Pat. No. 4,640,569 each disclose electrical connectors employed with cables employing associated pairs of conductors, each pair being surrounded by a separate shield. In each of these latter devices, however, the shields are not terminated to terminals in the respective multiposition electrical connector. In each case, the shields are interconnected to a surrounding connector shield.

In some applications where a flat cable is substituted for an existing discrete wire cable, it is still necessary to maintain the same signal positions in a standard electrical connector, despite the fact that the conductor arrangement in the flat cable does not correspond to the signal conductor pattern in the standard connector. U.S. Pat. No. 4,062,616 discloses an electrical connector in which a plurality of conductors in a flexible flat cable are terminated to conductors in a standard two row electrical connector. Although that device does provide a suitable means of terminating a plurality of signal conductors using an insulation displacement technique, no provision is made for termination of ground shields surrounding pairs of conductors at positions within the electrical connector which are unrelated to the signal and ground configuration in the cable. Furthermore, that device does not provide means for establishing a continuous outer EMI shield between the cable and the connector.

SUMMARY OF THE INVENTION

An electrical connector assembly for terminating a plurality of signal conductors and ground conductors in a shielded flat cable to corresponding conductors in a prescribed configuration, differing from the signal and ground conductor configuration in a shielded flat cable, includes a connector adapter consisting of an insulative housing and a plurality of signal terminals with a ground terminal for commoning ground conductors. The discrete signal terminals have conductor terminating means at one end and, in the preferred embodiment, these conductor terminating means would comprise an insulation displacement termination. These conductor terminating means would be spaced apart on centerlines which would differ from the spacing of the second ends of the signal conductors which would include a mating contact. The mating contacts would be located in a prescribed spacing corresponding to the location of the terminals in a standard conductor. Legs joining the conductor terminating portions of the signal terminals and the mating contacts can be bent or deployed to account for the centerline transition. A ground terminal, having one or more legs attached to a mating contact, similar to that employed with the signal terminals, is adapted to terminate all of the plurality of separate ground conductors and common these ground conductors. In the preferred embodiment of the invention, this ground terminal has a bus strip extending transversely of the signal terminals and includes shield termination means, such as crimped interconnections to the ground shield. The bus strip of the ground terminal would be deployed over the signal conductors and extend transversely thereof when positioned in the insulative housing of the connector adapter. The flat cable would extend into a cable receiving opening at one end of the connector adapter housing with the mating contacts extending from the opposite end where they can be positioned in the prescribed array of terminals in a standard connector. The legs of the signal and ground terminals would be received within terminal alignment grooves or channels to accommodate the change of centerline spacing.

BRIEF DESCRIPTION OF THE DRAWINGS

FIG. 3 is an exploded perspective view of the inner cable adapter assembly and an outer shield.

FIG. 8 is a view of the connector adapter base with representative signal terminals and with the ground bus terminal positioned in or exploded from their location in the connector adapter assembly.

FIG. 9 is a view of the partially assembled connector adapter assembly with signal conductors and the ground shields surrounding signal conductor pairs terminated to signal and ground terminals deployed in the connector assembly housing base.

FIG. 11 is a sectional view showing the adapter housing cover exploded from the subassembly consisting of the adapter assembly base with terminals positioned therein.

FIG. 12 is a view taken along section lines 12—12 of FIG. 11 showing the insulation displacement portion of a signal terminal.

FIG. 13 is a view taken along section lines 13—13 of FIG. 11 showing the manner in which the portion of the terminals adjacent the connector are precisely positioned within the adapter assembly.

DETAILED DESCRIPTION OF THE PREFERRED EMBODIMENT

Figures 1, 2A, 2B:
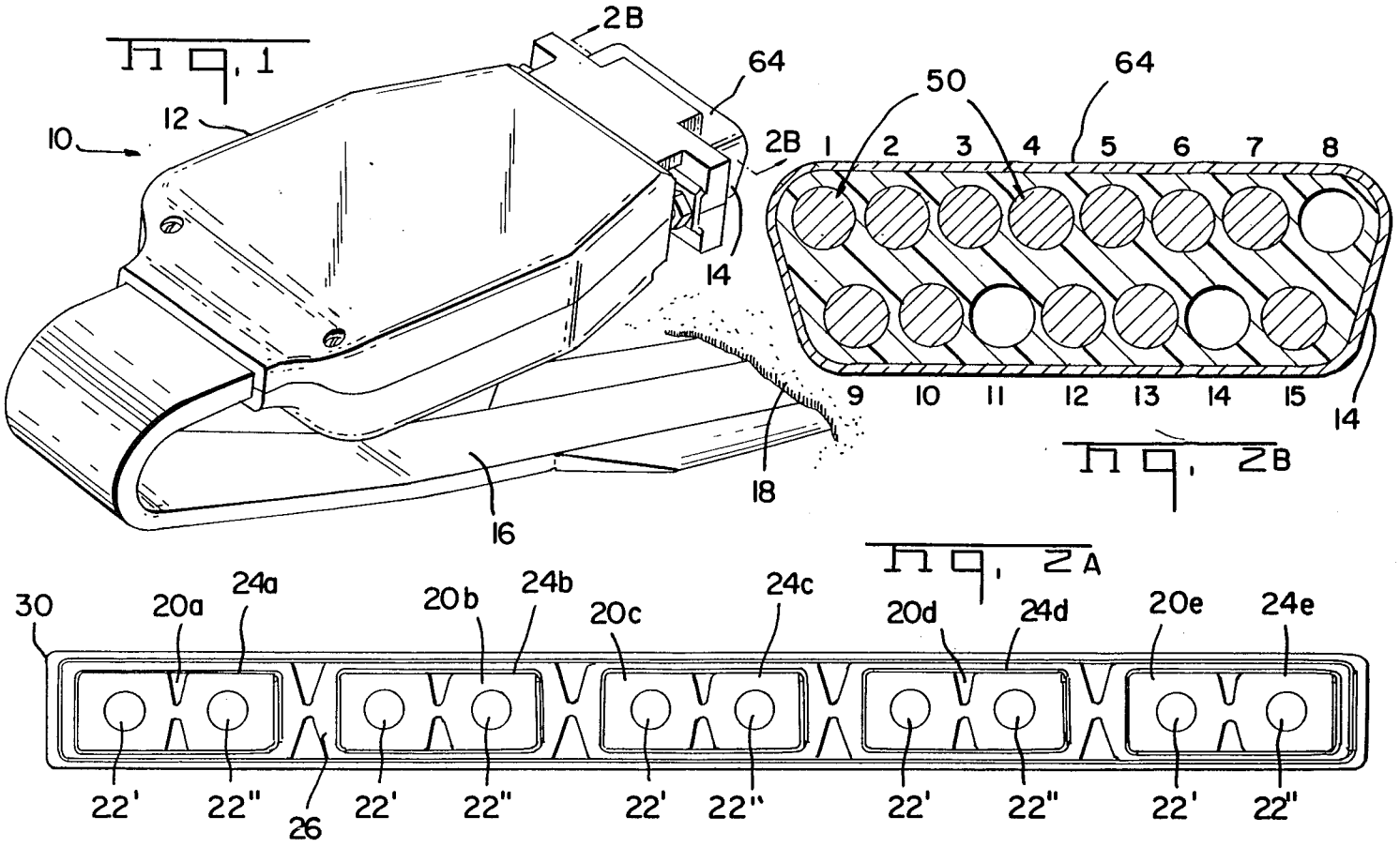
FIG. 1 is a perspective view of a connector assembly attached to a flat multiconductor cable of the type suitable for use in undercarpet wiring.
FIG. 2A is an end view of a multiconductor cable showing the position of signal conductors, ground shields and an outer EMI shield.
FIG. 2B is an end view of a standard connector in which the prescribed positions of the conductors are indicated by solid circles.
Figure 7:
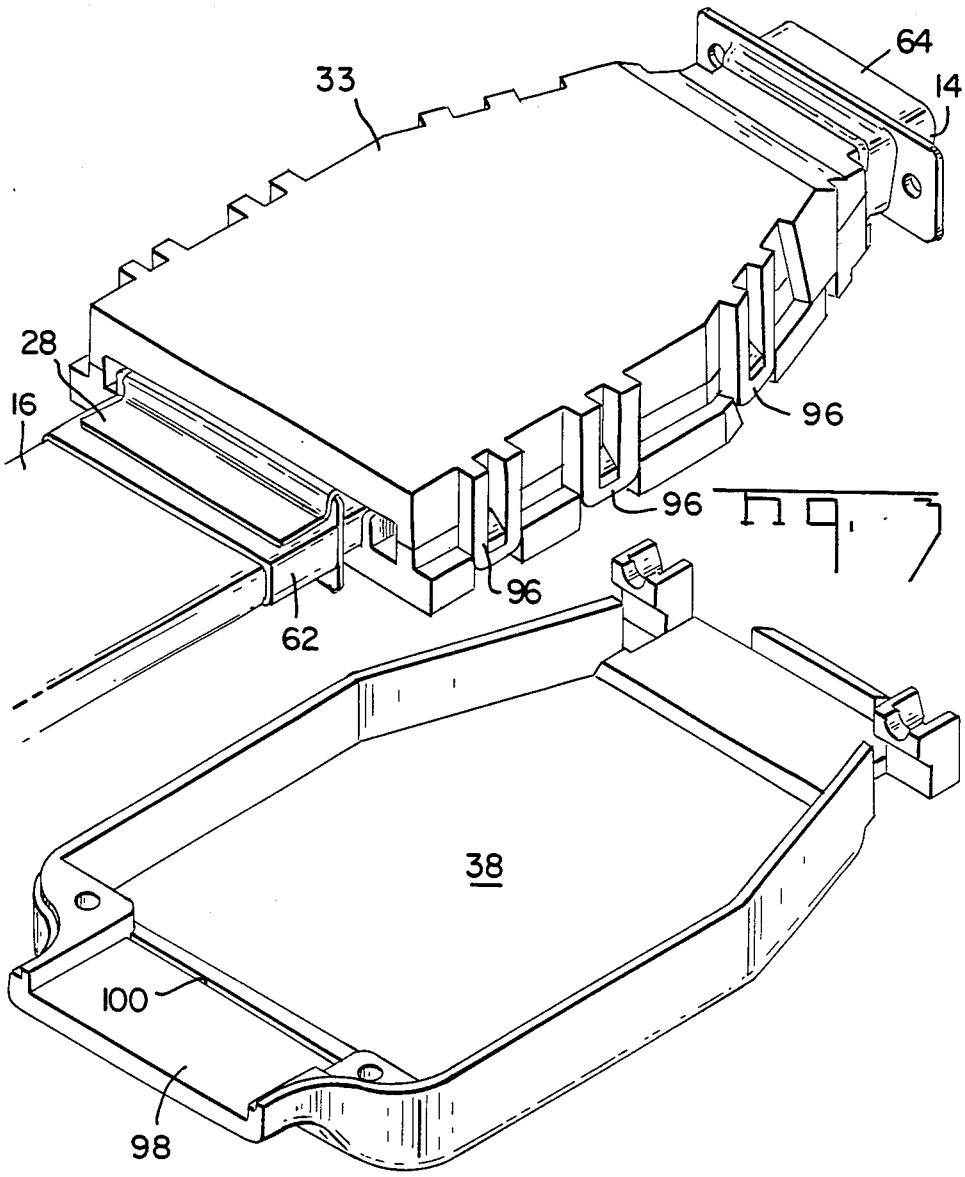
FIG. 7 is a view similar to FIG. 6 showing the commoning of the separate ground shields to the ground bus terminal and the deployment of the outer EMI shield in position for interengagement with a ground shield on the connector adapter assembly.

FIG. 1 depicts a connector assembly 10 including a connector adapter 12 and a standard electrical connector 14 intended for use with a flat multiconductor cable 16 of the type suitable for deployment under a carpet 18. The flat cable 16 employs a plurality of associated pairs 20*a–e* of signal conductors 22', 22'' with all of the signal conductors 22', 22'' lying in the same plane so that the cable will have a low profile suitable for installation in an undercarpet environment. Associated conductor pairs 20*a–e* are each surrounded by a foil shield 24*a–e* extending continuously around each pair 20*a–e* of conductors 22', 22''. The shielded conductor pairs 20*a–e* are in turn embedded within an extruded plastic insulative web 26 with an outer EMI shield 28, surrounding all of the conductors 22,24, being disposed on the exterior of the insulating web 26. Finally, an outer protective insulating web 30 formed of the same material is disposed around the outer EMI shield 28. Both the inner and outer web 26,30 may be formed by an extrusion process and a conventional material, such as polyvinylchloride, may be employed. The cable depicted herein is suitable for use in data networks such as the Ethernet network. Ethernet is a registered trademark of Xerox Inc.

A standard connector 14 having a plurality of rows of terminals arranged in a predetermined pattern can be employed to interconnect the conductors 22,24 in the flat cable 16 to a mating array of conductors. A standard electrical connector 14, such as the Amplimite high density pin and socket connector, can be employed. Amplitude is a registered trademark of AMP Incorporated. A standard two row connector 14 having fifteen positions can be employed to make interconnections to the ten signal conductors 22 and the five ground shields 24 in the cable depicted in FIG. 2A. The positions of the respective terminals would not be determined by the position of the signal conductors 22 or the ground shields 24 in the flat cable 16, but would generally be predetermined, since such connectors 14 are suitable for use with multiconductor cables which would not necessarily have a flat configuration. Indeed, in a standard configuration, separate connections for the individual ground shields 24 would not be made and the individual ground shields 24 would be commoned together with all ground being output only at two positions in the multirow prescribed terminal array or terminal pattern. In the preferred embodiment of this invention, the ground shields 24 will be attached at terminal positions 1 and 4 in the standard connector. The ten signal conductors 22 will be interconnected, respectively, at positions 9, 2, 10, 3, 12, 5, 13, 6, 7 and 15 as shown in FIG. 2B.

To interconnect the signal and ground conductors 22,24 of the flat cable 16 to the prescribed terminal pattern or array in the standard two row connector 14, an intermediate connector adapter assembly 12 is employed. This connector adapter assembly 12 provides means for accepting the signal conductors 22, the ground shields 24 surrounding associated pairs 20*a–e* of signal conductors, and the outer EMI shield 28 surrounding all of the conductors 22,24, located within the flat cable 16. This connector adapter assembly 12 consists of an insulative housing base 32 and insulative housing cover 34 which contain a plurality of signal terminals 40 and a ground terminal 50 suitable for commoning all of the ground shields 24*a–e* surrounding pairs 20*a–e* of associated signal conductors. A two-piece outer conductive shell, comprising hermaphroditic upper and lower members 38, is secured in surrounding relationship to the inner housing base 32 and cover and is, likewise, secured to the standard connector member 14. The inner housing assembly 33 is also attached to the standard connector member 14. A ferrule 52 engaging the outer EMI shield 28 holds the shield 28 in conductive engagement with the outer housing shell 36, which is formed of a conductive material to provide interconnection between the outer EMI shield 28 and the metal housing 64 of the standard connector 14. This outer housing shell 36 can be formed of a metallic member or of a metalized or conductive plastic housing shell. The two hermaphroditic shell members 38 are bolted together adjacent the cable receiving end and are bolted to the outer metal frame 64 of the standard connector member 14.

FIG. 3 shows the lower housing shell member 38 with the inner insulative housing assembly 33 attached to the connector 14 and exploded from the lower shell 38. The inner housing assembly 33 is configured to be received within the inner cavity of the outer housing shell subassembly.

Figure 4:
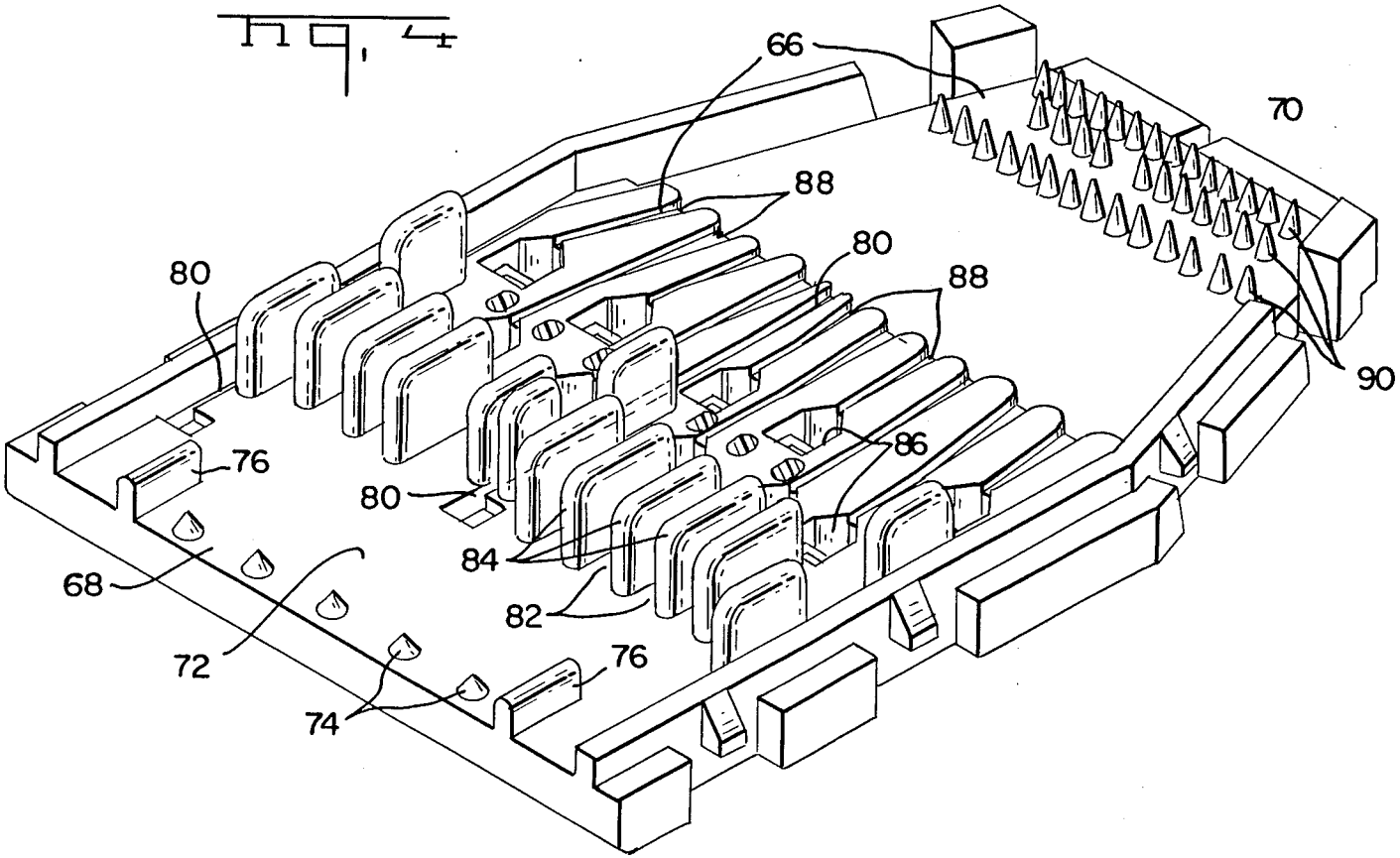
FIG. 4 is a perspective view of the housing base of the cable adapter assembly.
Figure 5:
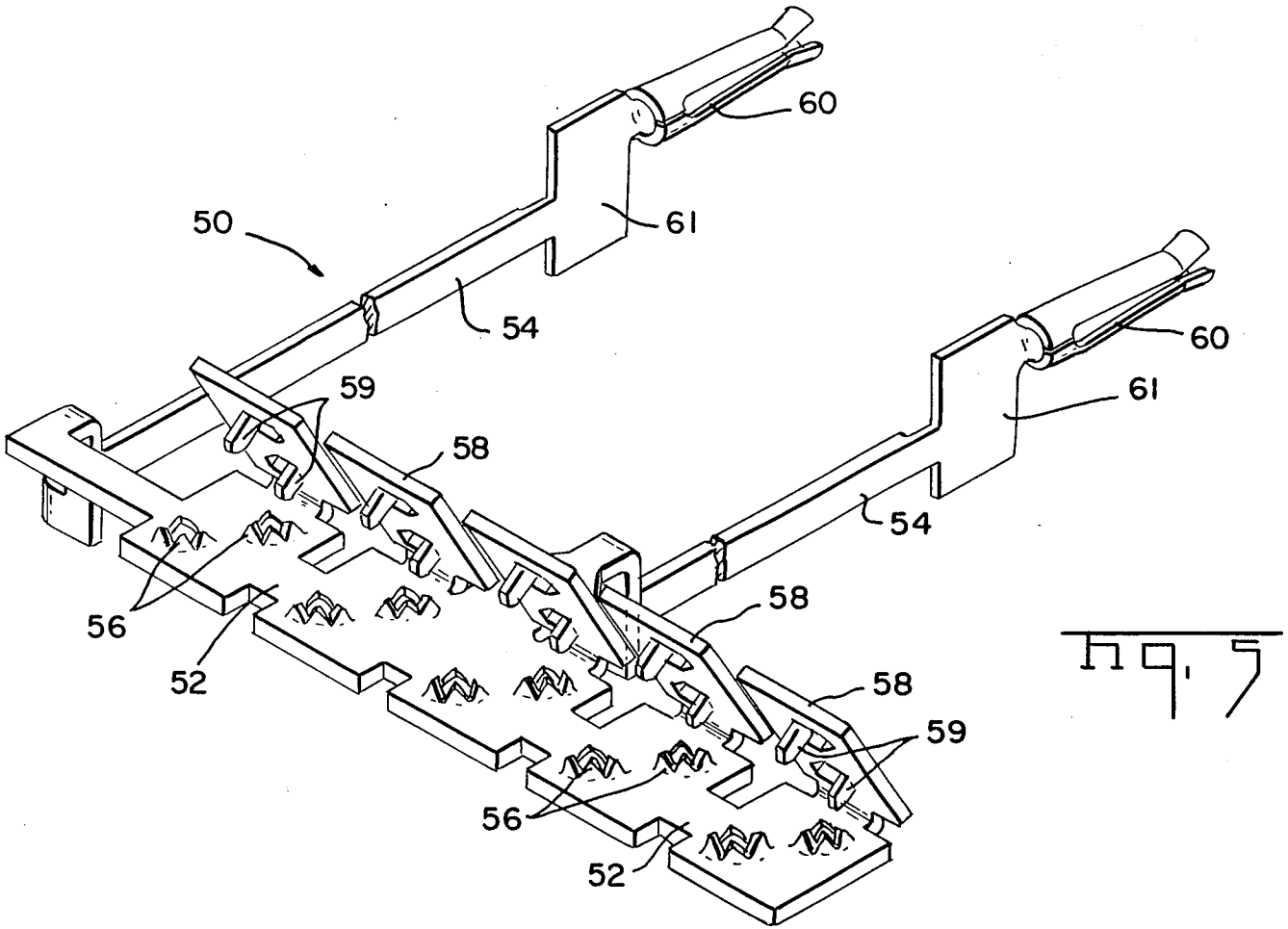
FIG. 5 is a view of a ground terminal bus assembly used to common separate ground shields and to interconnect the commoned ground shields to appropriate positions within the connector assembly.

The inner insulative housing 33 comprises a insulative base 32 formed of a conventional plastic and a matable cover 34. A plurality of signal terminals 40 are positioned within the insulative housing base 32. FIGS. 4, 8 and 9 show the manner in which a plurality of signal terminals 40 and a ground terminal 50, including means for commoning a plurality of separate ground shields 24*a–e*, are disposed within the insulative housing base 32.

There are two separate configurations of signal terminals 40 employed herein. The first signal terminals 40*a* are longer than the second terminals. The first terminals 40*a* also have a mating contact 42 located adjacent the top edge of the terminal 40*a*, whereas the second terminals 40*b* have a mating contact 42 of similar configuration but which are located adjacent the bottom edge of the terminal 40*b*. Each of the first and second signal terminals 40*a*,40*b* has a conventional insulation displacement conductor termination member 44 located adjacent a first end 41, with a mating contact 42 suitable for engaging a pin of conventional construction located on the opposite second end 43 of each signal terminal 40. An elongate central or intermediate leg 46 extends from the conductor termination member 44 on the first end 41 of each signal terminal 40 to the mating contact portion 42 on the second end 43. The entire terminal 40 is of stamped and formed configuration with the conductor termination end 44 being formed such that a plate having an insulation displacement slot 45 extending therein generally transversely to the remainder of each of the signal terminals 40. The slot 45 in this plate-like section receives a conductor inserted laterally of its axis into the slot and establishes an electrical conduction by means of a conventional insulation displacement technique. A pair of retention feet 47, having outwardly extending latching surfaces, extend downwardly from the lower edge of the insulation displacement plate 44 for engagement with the insulative housing base 32 in a manner to be subsequently described.

The elongate central portion 46 of each terminal 40 is deformable and, in general, has a height less than the height of the portion of the terminal adjacent the first 41 and second ends 43. A retaining tab section 48 is located adjacent the second end 43, and the formed socket 42 comprising the mating contact portion is of conventional construction. The retaining tab 48 and the formed socket section 42 are each insertable into cavities within a standard electrical connector member 14 in a conventional manner. This mating socket contact 42 and the retaining tab 48 are received within the housing member in the same fashion as depicted in U.S. Pat. No. 4,062,616, which is incorporated herein by reference.

The ground terminal 50 includes a transversely extending bus strip section 42 and a plurality of legs 54 extending from one edge thereof. In the preferred embodiment of this invention, a plurality of upwardly extending lances 56 is located on the lower portion of the bus strip 52 in position to engage separate ground shields 24*a–e* surrounding associated pairs 20*a–e* of conductors in the flat cable 16. A plurality of deformable flaps 58 extend from the rear edge of the lower portion of the bus strip 52 upwardly at an angle relative to the lower portion. These flaps 58 include lances 59 struck therefrom suitable for receipt within the upraised tab portions 56 of the lower portion of the bus strip 52. These deformable upper flaps 58 can be crimped down over the separate shield 24*a–e*, in a manner to be subsequently described, to form a secure termination to each of the separate ground shields 24*a–e*. The bus strip 52 thus serves as a means for commoning all of the separate ground shields 24*a–e* surrounding separate pairs 20*a–e* of associated signal conductors. A pair of legs 54 extend from the bus strip 52 at discrete locations. Each leg 54 is similar in construction to the legs 46 of the signal terminals 40. The ground terminal legs 54 are attached to the lower portion of the bus strip 52 and the legs are formed such that each leg is positioned on edge relative to the lower surface of the conductor housing 32, in the same manner as the legs for the various signal terminals.

Figure 10:
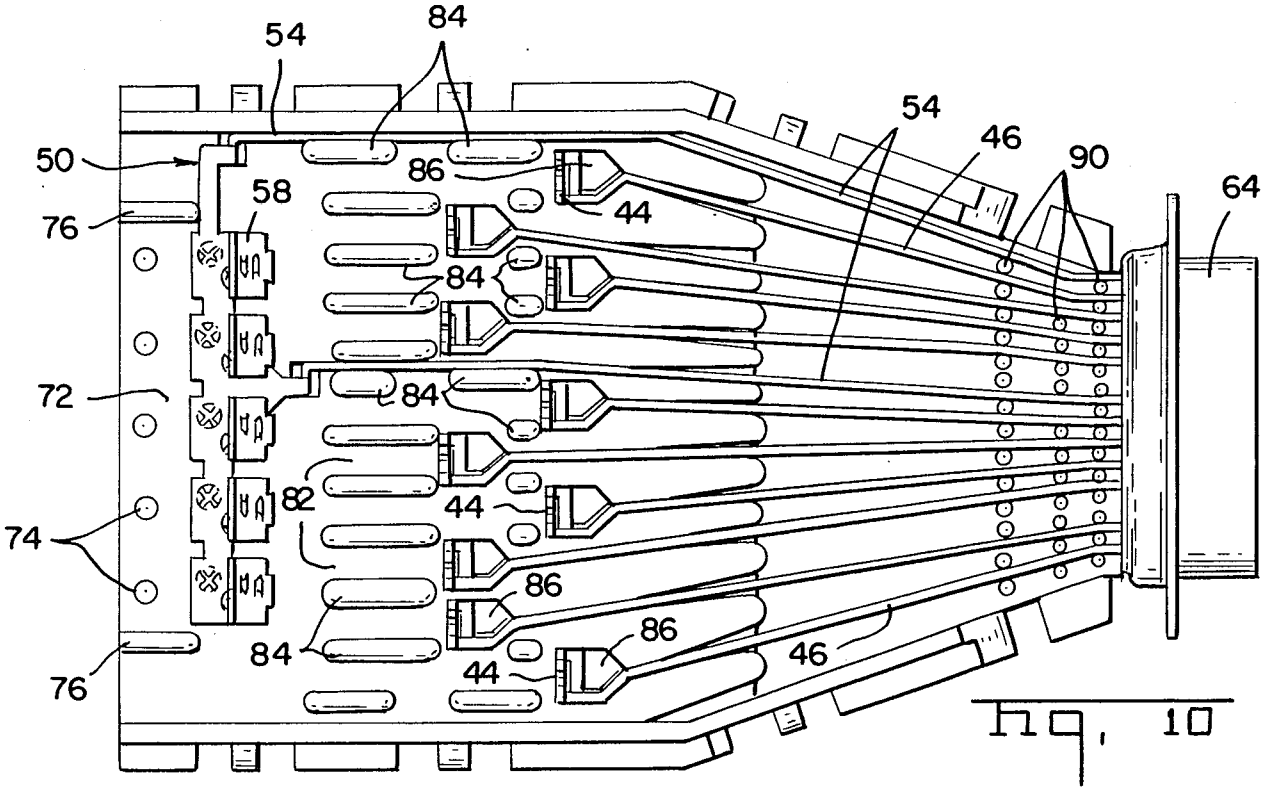
FIG. 10 is a plan view of the connector adapter showing the position of the signal and ground terminals.
Figure 14:
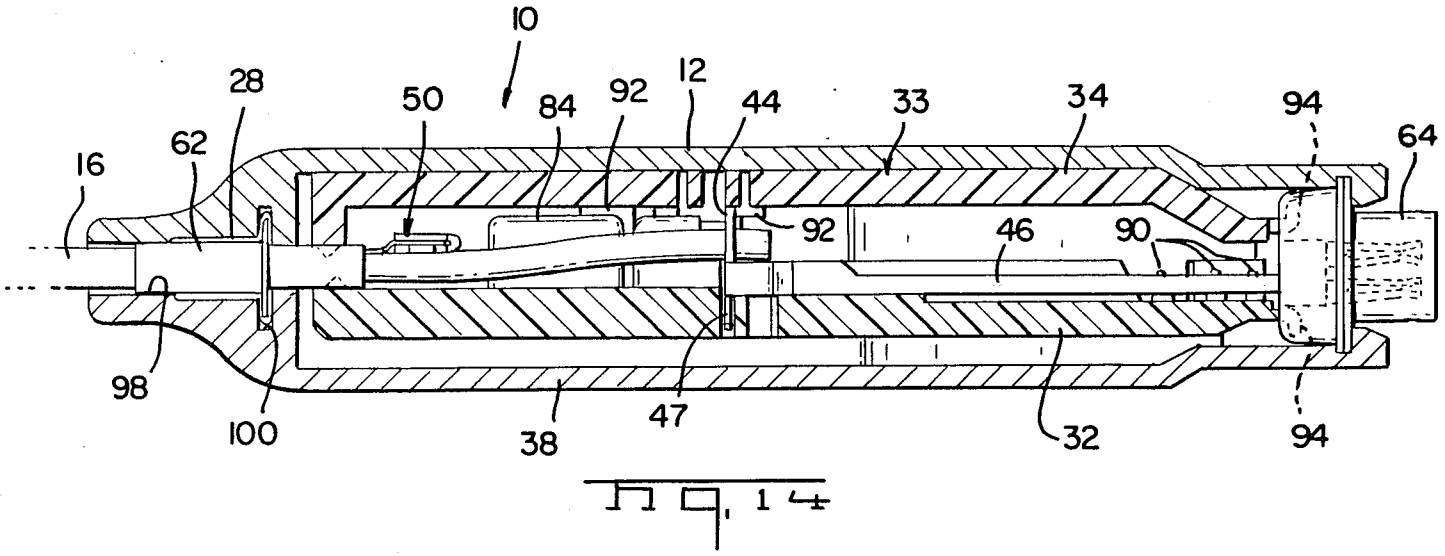
FIG. 14 is a side view of an assembled connector attached to a standard multirow electrical connector showing the outer conductive shield surrounding the adapter and extending between the cable and the standard electrical connector.

The signal and ground terminals 40,50 are received within terminal aligning means 66 on the upper surface of the housing base 32. The housing base 32 has a cable receiving opening 68 adjacent one end and a connector engaging face at the opposite mating end 70. A cable support surface is defined adjacent the cable receiving opening 68 on the housing. A plurality of strain relief embossments 74, suitable for engaging the outer insulation of the cable, are located immediately adjacent the cable receiving opening 68 and extend upwardly from the cable support surface 72. A pair of alignment ribs 76 also extend upwardly from the cable support surface 72 and the cable can be positioned between these alignment ribs 76. A pair of ground terminal pockets 78 are located on the cable support surface 72 in position for alignment with the forward end of the legs 54 of the ground terminal 50. These ground terminal pockets 78 are contiguous with grooves 80 extending rearwardly on the lower face of the housing base 32 adjacent the rear of the cable support surface 72. The plurality of separator ribs 84 extend upwardly from the housing base at the rear of the cable support surface 72 define a plurality of signal conductor channels 82. These signal conductor channels 82 are spaced apart on centerlines greater than the centerline spacing of signal conductors 22 in the flat cable 16, and the conductors 22 can be deployed outwardly and positioned in alignment with the channels 82 between adjacent separator ribs 84. These channels 82 are in alignment with conductor terminating pockets 86 located in the lower face of the insulative housing 32 rearwardly of the separator ribs 84. Each of these pockets 86 is configured to receive the lower portion of the conductor terminating first end 41 of each of the signal conductors 40. The terminal pockets 86 are configured generally in two rows with the first terminals 40*a* being inserted into the more forward pockets and the second terminals 40*b* being inserted into the more rearward pockets. As shown in FIG. 10, the terminal pockets 86 in each row are not necessarily in complete alignment and can be staggered somewhat to account for the differential length between each terminal pocket 86 and the rear 70 of the housing 32. The conductor terminating pockets 86 located adjacent the side of the housing base 32 can be more rearwardly positioned than those terminal pockets adjacent the center of the base since the more outwardly disposed terminals must be bent inwardly. A terminal alignment groove 88 extends rearwardly from each of the signal terminal pockets 86 and a groove 80 extends rearwardly from the conductor terminating pockets 78. These grooves 80,88 converge towards the rear of the housing 32 since the spacing between terminals adjacent the rear mating end 70 is less than the spacing between adjacent terminal pockets 86 located intermediate the cable receiving opening 68 and the rear mating end 70 of the housing base 32. The respective terminal legs 46,54 are received within these grooves 86,80 by bending the legs so as to conform with the general contour of each groove. Three rows of upstanding conical posts 90 are located adjacent the rearward end 70 of the housing base 32. These conical posts 90 are spaced apart to receive the rear terminal legs 46,54 between adjacent posts 90. These conical posts 90 define alignment paths which are in line with the positions which the terminals 40,50 will occupy in the housing 32. Note that these conical projections 90 provide a centering effect for the individual terminals and a large converging path through which the legs 46,54 of each terminal can be formed between adjacent conical posts 90. Conical posts 90 and grooves 80,88 thus serve as terminal alignment means 66.

The second component of the insulative housing 33 of the connector adapter 12 is a cover 34 which can be latched to the insulative base 32. The insulative cover 34 has a plurality of stuffers 92 extending inwardly from its upper face. These stuffers 92 are aligned with the insulation displacement terminating portions 44 of the signal conductors 40 which are held in the base 32. When the cover 34 is mated to the base 32, the conductors 22 are forced into the slots in the insulation displacement conductor terminating portions 44 to establish a mass termination electrical contact between the signal conductors 22 in the cable 16 and the signal terminals 40. Both the insulative base 32 and the insulative cover 34 have a lip 94 located at the mating end 70. These lips 94 engage the outer metallic shell 64 of the standard connector 14 to hold the insulative housing 33 secured to the connector member 14. Note that both the base 32 and the cover 34 can be pivoted relative to the connector member 14, and this relative pivotal movement will bring the cover 34 into engagement with the base 32 with a plurality of latches 96 located on the exterior of both the base 32 and the cover 34 engaging to hold the base 32 and cover 34 together.

The flat cable 16 to be terminated using this particular connector assembly 10 and adapter 12 also includes an EMI shield 28 extending around all of the signal conductors 22. This shield 28 is to be terminated to the metal shell 64 of the standard connector 14 to maintain a continuous EMI shield 28. Hermaphroditic outer shell members 38 are employed to form this continuous EMI shield around the adapter assembly 10. Each hermaphroditic shell member 38 receives a portion of the insulative housing 33 in its interior. At the rear cable receiving end 98 of the outer shell member, a planar cable receiving surface is defined. A slot 100 extends laterally along this surface. This slot 100 is dimensioned for receipt of a flange 102 on a metallic ferrule 62 which is employed to hold the outer EMI cable shield in contact with the conductive material forming the outer shell member.

The signal conductors 22, the ground shields 24*a–e* surrounding associated pairs 20*a–e* of signal conductors, and the outer EMI shield 28 are assembled to the connector adapter 12 and to the standard connector member 14 in the following manner. The signal terminals 40 and the ground terminal 50 are first positioned in the connector member 14 with the mating contact portions 60 located in the positions shown in FIG. 2B. The legs 46 and 54 extend outwardly from the connector member 14. The insulative base 32 is next secured to the connector member 24. The conductor terminating portions 44 are then located in the conductor terminating pockets 86 in the base 32 and the legs 46 of each of the signal terminals 40 are formed to be received in the terminal alignment grooves 88 and between terminal alignment conical posts 90, located at the mating end 70 of the housing. Thus, the terminals 40 converge from the centerline of the adjacent, but staggered, conductor terminating portions 44 to the spacings in the standard connector member 14. The legs 54 of the ground terminal 50 can be formed for receipt in terminal aligning grooves 80 and between posts 90 for location in the connector member 14. The individual signal conductors 22 can be deployed in channels 82 formed by spaced apart separator ribs 76 in the insulative housing base 32 and the ends of the signal conductors 22 can be positioned in the wire entry portions of the insulation displacement conductor terminating portions 44. The bus strip 52 of the ground terminals 50 will extend across the top of the signal conductors 22 when the signal conductors are located along the cable supporting surface 72 of the insulative base 32.

Figure 6:
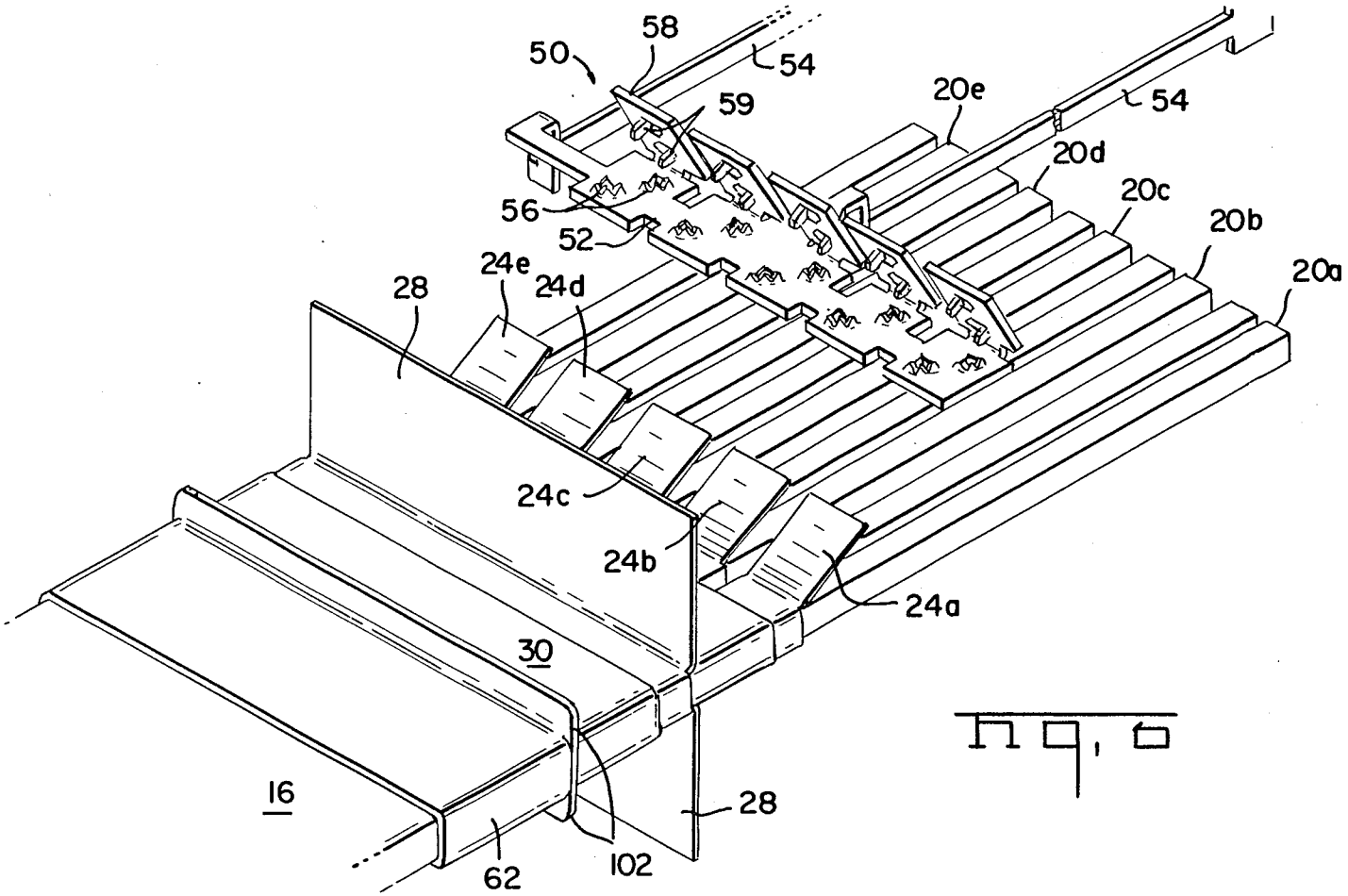
FIG. 6 is a view of the end of a cable with both the conductor pair ground shields and the outer EMI shield deployed in preparation for termination.
Figure 7:
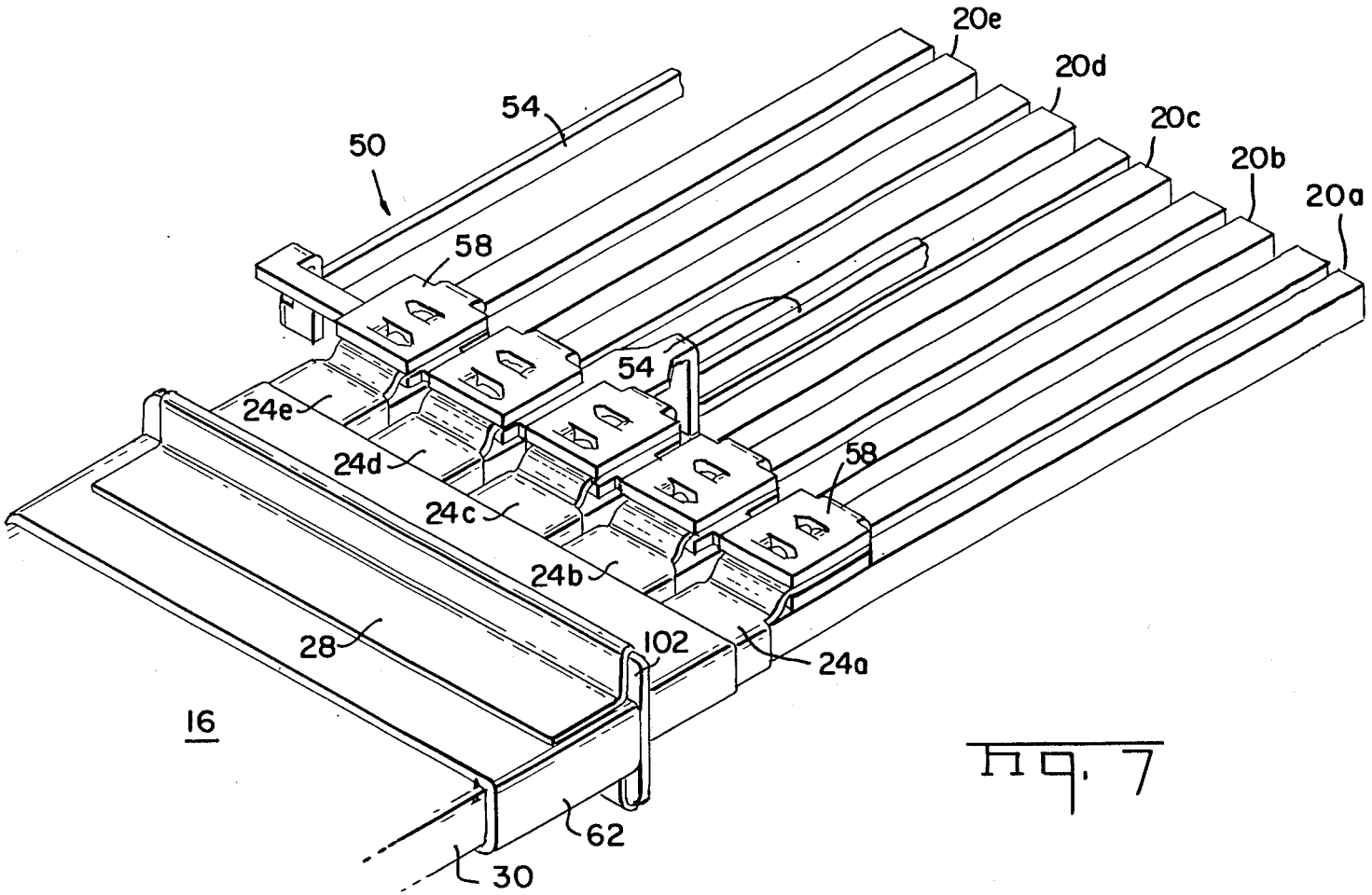
Figure 7:
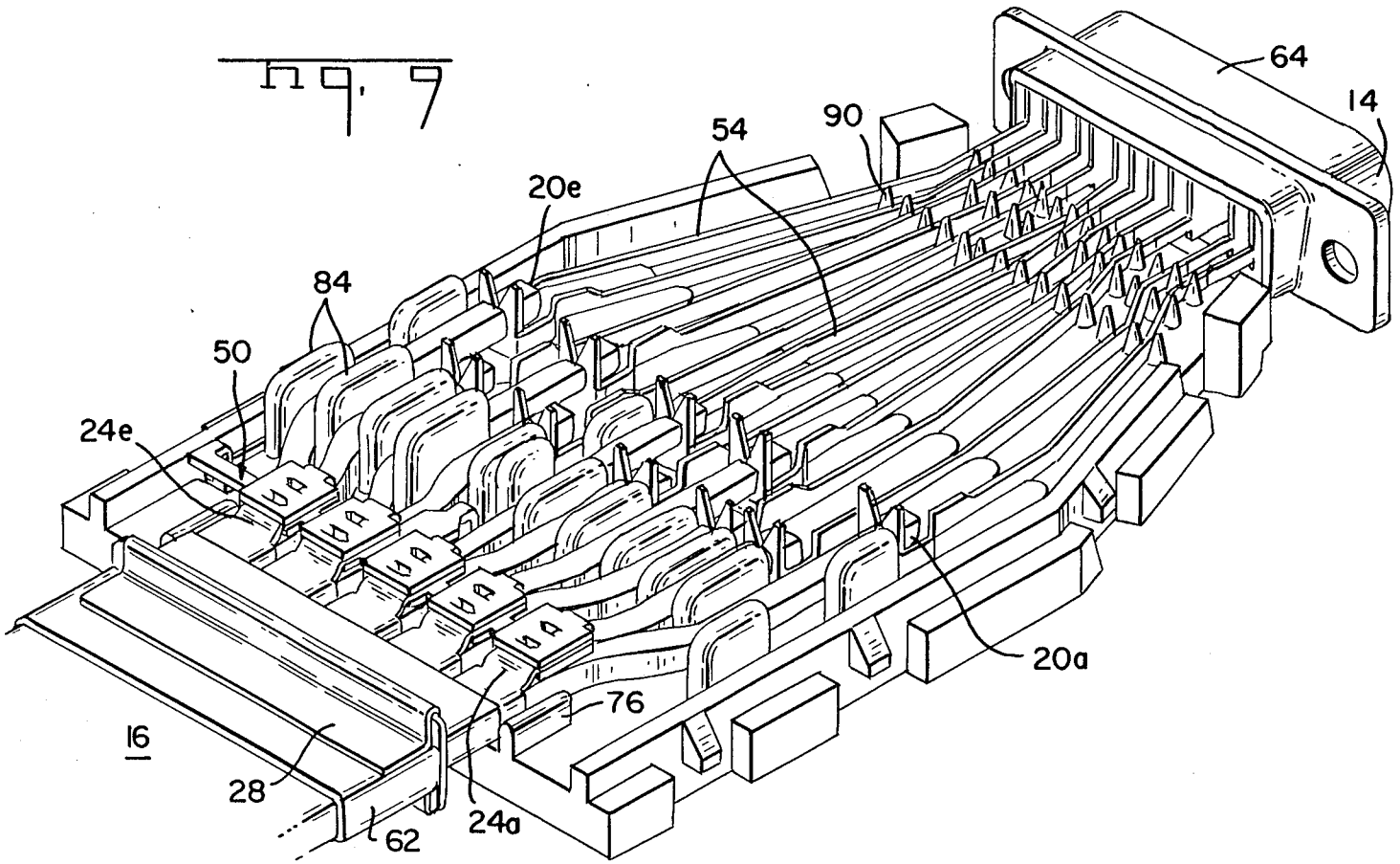

The cable 16 can be prepared for termination by first removing the outer insulating web 30 and by removing the ends of the outer EMI shield 28, leaving only the top and bottom of the shield 28 intact in the portion of the cable 16 from which the outer insulation 30 has been removed. The inner web 26 between the outer EMI shield 28 and the plurality of inner ground shields 24*a–e* surrounding associated conductor pairs 20*a–e* can next be removed adjacent the end to expose the separate EMI shields 24*a–e* surrounding associated conductor pairs 20*a–e*. As shown in FIG. 6, these shields 24*a–e* are completely removed from the cable in the portion immediately adjacent the end of the cable 16. A portion of the top of the shields 24*a–e*, however, remains connected to the ground shield at a location between the end of the cable 16 and the end of the insulation 26 separating the outer EMI shield from the inner ground shield 24*a–e* surrounding associated signal conductor pairs 20*a–e*. These portions or flaps can be bent upwardly and are intended for termination by the bus strip 52 of the ground terminal 50. These upwardly extending portions of the separate ground shields can be inserted between the upper and lower portions of the bus strip 52 and the upper flap 58 can be bent downward with the lance 59 extending through the lower portion of the bus strip 52 so that the tangs 56 and lances 59 form a secure mechanical and electrical connection to the shields 24*a–e*, commoning all of the ground shields 24*a–e* surrounding associated conductor pairs 20*a–e*.

Note that the ferrule 62 has been inserted around the cable 16 prior to deployment of the outer EMI shield 28 and the inner ground shield 24*a–c*, and the EMI shield 28 can be folded back over the flanges 102 on the top and bottom of the ferrule 62. With the cable 16 in the position shown in FIG. 9, the insulative housing cover 34 can be secured to the insulative base 32 with the stuffers 92 in the cover 34 forcing the conductors 22 into the insulation displacement conductor terminating portions 44 of the signal terminals 40. At this point, the insulative housing assembly 33, including the terminated cable 16, can next be positioned between the two outer conductive shell members 38. The flanges 102 on the ferrule 62, with the EMI shield 28 deployed around the flanges 102, will be received within the slots 100 adjacent the conductor receiving end of the outer shell members 38. This ferrule 62 will wedge, force or bias the EMI shield 28 into electrical engagement with the outer conductive shell members 38. With the insulative housing 33 secured to the connector member 14 by the lip 94 and with the terminals 40,50 extending into the connector member 14, the outer conductive shell 36 can then be bolted to the conductive shell of the connector member 14 to form a continuous EMI shield surrounding the connector adapter subassembly 12.

The preferred embodiment permits the conductors in a cable to be suitable for use in an Ethernet network and would permit interconnection of signal and ground conductors in a flat cable at predetermined positions in a standard Amplimite electrical connector. The invention, however, is not limited to this best mode contemplated by the inventors since similar interconnections could be made between other shielded flat cables and other connectors or connectors having a different prescribed array of terminals. Such other embodiments, incorporating the invention described herein, would be apparent to one of ordinary skill in the art. Therefore, the following claims are not limited solely to the preferred embodiment described herein.

What is claimed is:

1. An electrical connector assembly for terminating a plurality of signal conductors and a plurality of ground conductors in a flat cable to a connector member having terminal positions in a plurality of rows, the connector assembly comprising:

an insulative housing engagable with the connector member;

a plurality of first terminals, each having first and second ends, with a mating contact adjacent the top edge of the terminal second end;

a plurality of second terminals, each having first and second ends, with a mating contact adjacent the bottom edge of the terminal second end;

signal conductor terminating means on the first ends of the first and second terminals with the signal conductor terminating means extending transversely relative to and for terminating signal conductors in a flat cable with the mating contacts of the first terminals being located in an upper row and the mating contacts of the second terminals being located in a lower row;

a third terminal including a bus strip on a terminal first end, extending in a transverse direction and spaced from the signal conductor terminating means, the bus strip having ground conductor terminating means for commoning the ground conductors, and a mating contact on an opposite second end;

each of the first, second and third terminals having an elongate flat central leg mounted on edge in the housing, the flat legs of the terminals being side-by-side and selectively bent to alter the spacing between first and second ends of a plurality of terminals so that the configuration of the mating contacts of the plurality of terminals conforms to the terminal positions of the connector member.

2. The connector assembly of claim 1 wherein the signal conductor terminating means on the first and second terminals comprise insulation displacement conductor terminating means and the ground conductor terminating means on the bus strip comprise a plurality of crimping conductor terminating means spaced apart on the bus strip.

3. The connector assembly of claim 2 wherein the ground conductor terminating means comprise means for terminating a flat conductive member, the ground conductors in the flat cable each comprising a flat conductive member at least partially surrounding at least one signal conductor.

4. The connector assembly of claim 3 wherein the signal conductor terminating means of the first and second terminals are closer to the connector member than the bus strip of the third terminal.

5. The connector assembly of claim 4 wherein the second terminals are longer than the first terminals, the signal conductor terminating means of the first and second terminals being staggered.

6. The connector assembly of claim 2 wherein the insulative housing comprises a base and a cover, the terminals being retained with the legs thereof within grooves in the base, the cover including a plurality of projections alignable with the insulation displacement signal conductor terminating means to insert signal conductors into the insulation displacement signal conductor terminating means when the cover is mated to the base.

7. The connector assembly of claim 1 wherein the bus strip extends from the top edge of each leg of the third terminal and transversely to each leg of the third terminal.

8. The connector assembly of claim 7 wherein a plurality of spaced apart third terminal legs extend from the bus strip.

9. The connector assembly of claim 1 wherein the ground conductor terminating means comprise a plurality of upturned tangs in the bus strip and a flange initially bent upward from the bus strip and deformable to terminate the ground conductors between the flange and the upturned tangs.

10. The connector assembly of claim 1 further comprising a conductive outer shell enclosing the insulative housing and a ferrule received within the shell, the shell and ferrule together comprising means for engaging an outer shield surrounding a plurality of both the ground conductors and the signal conductors.

* * * * *